US008602911B2

(12) United States Patent
Solheim

(10) Patent No.: US 8,602,911 B2
(45) **Date of Patent: *Dec. 10, 2013**

(54) GOLF CLUB HEADS WITH GROOVES AND METHODS OF MANUFACTURE

(75) Inventor: John A. Solheim, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 547 days.

This patent is subject to a terminal disclaimer.

(21) Appl. No.: 12/832,859

(22) Filed: Jul. 8, 2010

(65) Prior Publication Data

US 2012/0010017 A1 Jan. 12, 2012
US 2013/0225318 A9 Aug. 29, 2013

Related U.S. Application Data

(63) Continuation of application No. 12/034,065, filed on Feb. 20, 2008, now Pat. No. 7,780,548.

(51) Int. Cl.
*A63B 53/04* (2006.01)

(52) U.S. Cl.
USPC ..... 473/331

(58) Field of Classification Search
USPC ..... 473/330, 331
See application file for complete search history.

(56) References Cited

U.S. PATENT DOCUMENTS

| | | | | |
|---|---|---|---|---|
| 1,536,616 | A | 5/1925 | Manning | |
| 4,290,606 | A | 9/1981 | Maxwell | |
| 4,768,787 | A | 9/1988 | Shira | |
| 4,902,016 | A | 2/1990 | Boone | |
| 4,964,641 | A | 10/1990 | Miesch et al. | |
| 5,037,102 | A * | 8/1991 | Fukayama et al. | 473/330 |
| 5,437,088 | A | 8/1995 | Igarashi | |
| 5,591,092 | A | 1/1997 | Gilbert | |
| 5,595,547 | A | 1/1997 | Lekavich | |
| 5,618,239 | A | 4/1997 | Rife | |
| 5,637,044 | A | 6/1997 | Swash | |
| 5,709,616 | A * | 1/1998 | Rife | 473/330 |
| 6,733,400 | B2 | 5/2004 | Sherwood | |
| 6,814,673 | B2 | 11/2004 | Wahl et al. | |
| 6,849,004 | B2 | 2/2005 | Lindsay | |
| 6,981,923 | B2 | 1/2006 | Chappell | |
| 7,056,226 | B2 | 6/2006 | Kennedy | |
| 7,066,833 | B2 | 6/2006 | Yamamoto | |
| 7,156,751 | B2 | 1/2007 | Wahl et al. | |
| 7,179,175 | B2 | 2/2007 | Kennedy, III | |
| 7,275,999 | B2 | 10/2007 | Sherwood | |
| 7,445,561 | B2 * | 11/2008 | Newman et al. | 473/330 |
| RE40,874 | E | 8/2009 | Wahl et al. | |

(Continued)

FOREIGN PATENT DOCUMENTS

| | | |
|---|---|---|
| EP | 1234602 | 8/2002 |
| GB | 2457745 | 8/2009 |

(Continued)

OTHER PUBLICATIONS

USGA Announces Rules Changes on Golf Club Grooves; Aug. 6, 2008; Your Daily Golf Transactions Newsletter The Wire; 3 pages.

(Continued)

*Primary Examiner* — Alvin Hunter

(57) ABSTRACT

Embodiments of club heads with grooves are described herein. Other embodiments and related methods are also disclosed herein.

28 Claims, 7 Drawing Sheets

(56) References Cited

U.S. PATENT DOCUMENTS

| | | | | |
|---|---|---|---|---|
| 7,568,983 | B2 | 8/2009 | Gilbert | |
| 7,594,863 | B2 | 9/2009 | Ban | |
| 7,780,548 | B2 * | 8/2010 | Solheim | 473/330 |
| 7,798,918 | B2 * | 9/2010 | Ban et al. | 473/330 |
| 7,819,756 | B2 * | 10/2010 | Ban et al. | 473/330 |
| 7,862,450 | B2 * | 1/2011 | Gilbert et al. | 473/330 |
| 7,922,601 | B2 * | 4/2011 | Ban et al. | 473/330 |
| 2004/0087387 | A1 | 5/2004 | Wahl et al. | |
| 2004/0192460 | A1 | 9/2004 | Sherwood | |
| 2005/0043113 | A1 | 2/2005 | Mann et al. | |
| 2005/0130761 | A1 | 6/2005 | Vokey et al. | |
| 2005/0143187 | A1 | 6/2005 | Kennedy | |
| 2007/0078027 | A1 | 4/2007 | Wong | |
| 2007/0082752 | A1 | 4/2007 | Boyd | |
| 2007/0149312 | A1 | 6/2007 | Gilbert | |
| 2008/0039230 | A1 | 2/2008 | Lin et al. | |
| 2009/0036228 | A1 | 2/2009 | Ban et al. | |
| 2009/0082129 | A1 | 3/2009 | Ban et al. | |
| 2009/0209361 | A1 * | 8/2009 | Solheim | 473/331 |
| 2009/0247318 | A1 | 10/2009 | Ban et al. | |
| 2009/0313806 | A1 | 12/2009 | Gilbert | |
| 2009/0325728 | A1 * | 12/2009 | Solheim et al. | 473/331 |
| 2010/0056295 | A1 | 3/2010 | Ban et al. | |
| 2010/0113180 | A1 | 5/2010 | Nakamura | |

FOREIGN PATENT DOCUMENTS

| | | |
|---|---|---|
| JP | 10179824 | 7/1998 |
| JP | 10179825 | 7/1998 |
| JP | 10248974 | 9/1998 |
| JP | 2000254261 | 9/2000 |
| JP | 2000296191 | 10/2000 |
| JP | 2002065911 | 3/2002 |
| JP | 2002239040 | 8/2002 |
| JP | 2004136030 | 5/2004 |
| JP | 2009034393 | 2/2009 |
| WO | 02085462 | 10/2002 |
| WO | WO2006015420 | 2/2006 |

OTHER PUBLICATIONS

Determination of Groove Conformance; Aug. 2008; 9 pages.
USGA: Notice to Manufacturers, New Groove Regulations; Aug. 5, 2008; 3 pages.
Notice to Manufacturers: New Groove Regulations; Feb. 27, 2007; http://www.usga.org/equipment/notices/new_groove_regulations.html; Aug. 20, 2007; 3 pages.
Current Rule / Proposed Rule; http://www.usga.org/equipment/notices/PROPOSED%20GROOVE%20RULE.pdf; Aug. 20, 2007; 3 pages.
Groove Measurement Procedure Outline; http://www.usga.org/equipment/notices/Groove%20Measurement%20Procedure%20Outline.pdf; Aug. 20, 2007; 9 pages.

* cited by examiner

Fig. 1
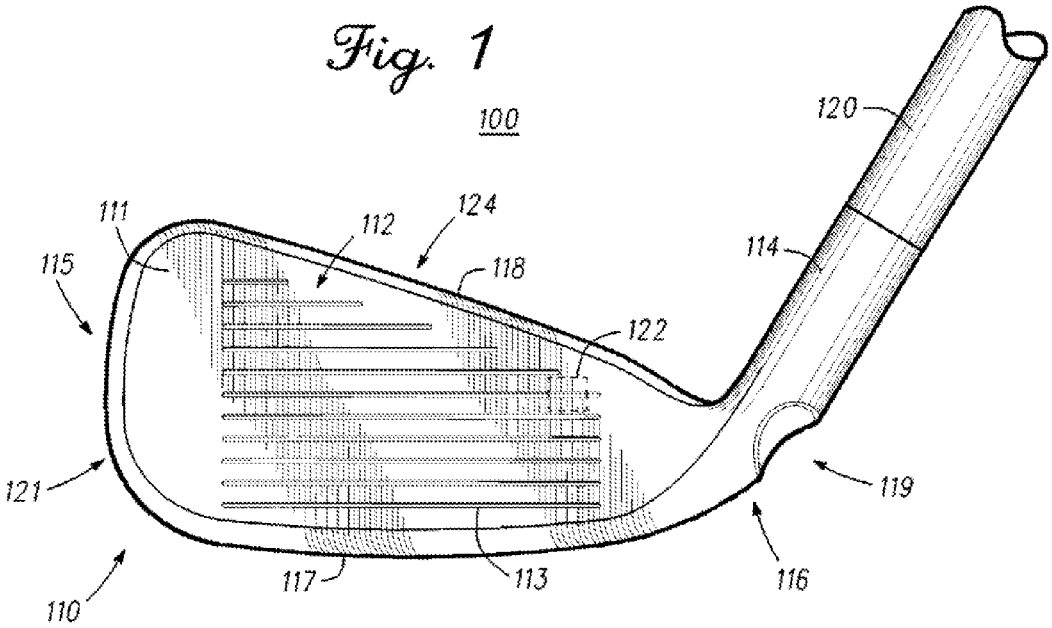
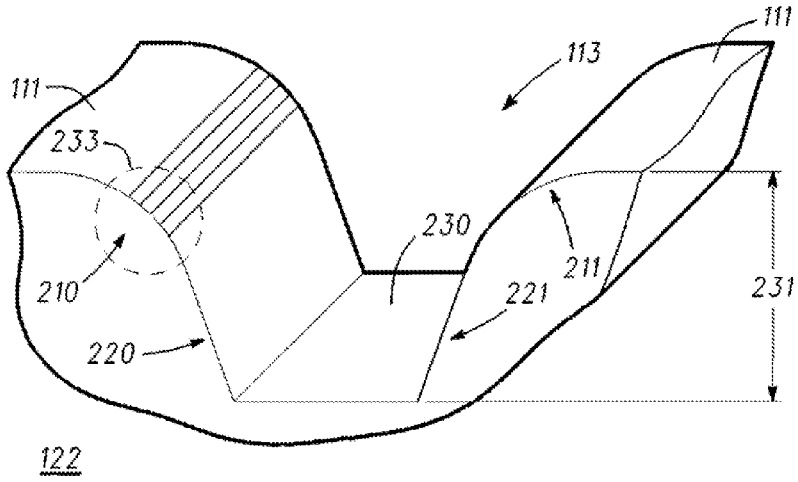
Fig. 2

Fig. 3
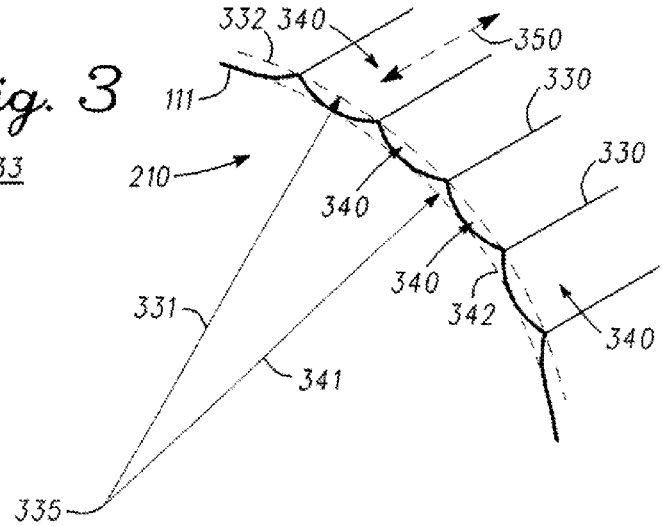
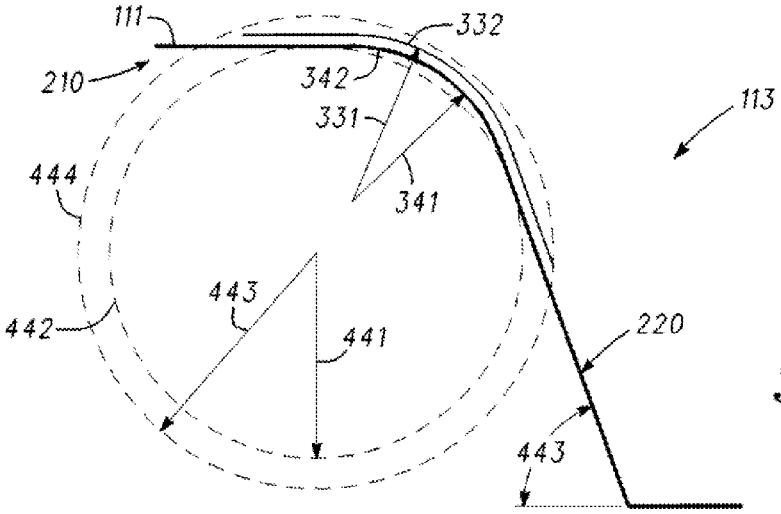
Fig. 4
Fig. 5
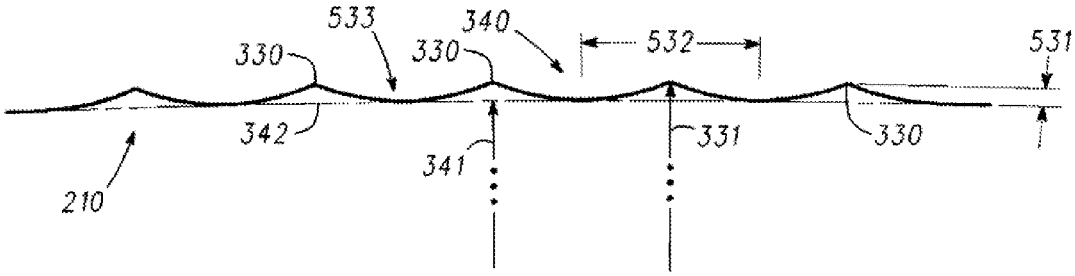

Fig. 21
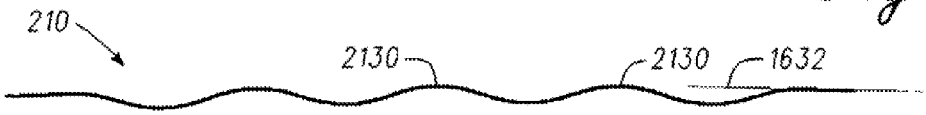
Fig. 22
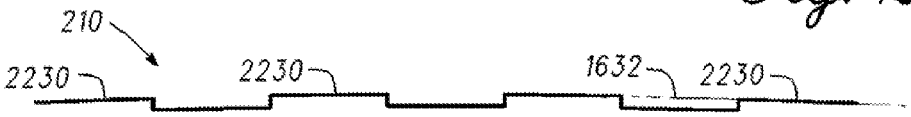
Fig. 23
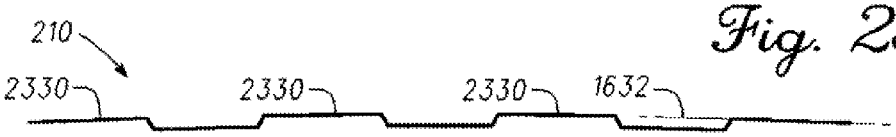
Fig. 24
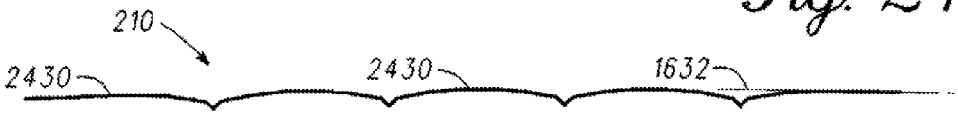
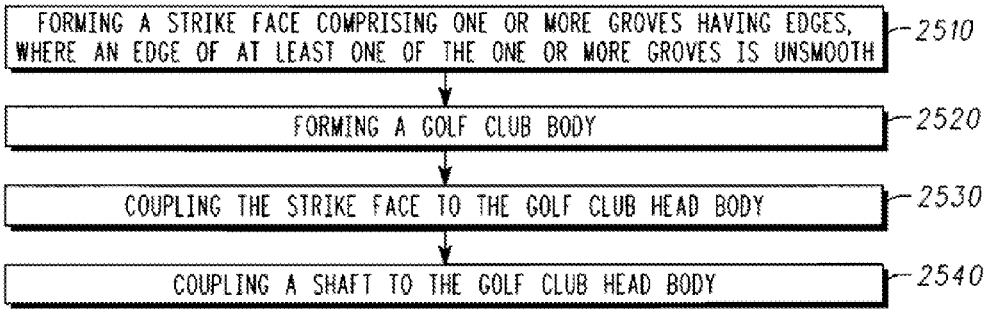
Fig. 25 2500

GOLF CLUB HEADS WITH GROOVES AND METHODS OF MANUFACTURE

CROSS-REFERENCE TO RELATED APPLICATION

This patent application claims priority to U.S. patent application Ser. No. 12/034,065, filed on Feb. 20, 2008. The disclosure of the referenced application is incorporated herein by reference.

TECHNICAL FIELD

This disclosure relates generally to golf clubs, and relates more particularly to golf club heads with grooves and their methods of manufacturing.

BACKGROUND

Typically, a golf club head can include a club face with a plurality of parallel grooves extending between a toe end and a heel end of the club face. In particular, the plurality of grooves in an iron-type club head can channel out water, sand, grass, and/or other debris that may come between a golf ball and the club face in order to improve the grip between the golf ball and the club face. The grooves can have various cross-sectional shapes such as a square or rectangular shape, a V-shape, or a U shape.

DESCRIPTION OF THE DRAWINGS

FIG. 1 depicts a front view of a golf club, according to a first embodiment;

FIG. 2 depicts a cross-sectional view of a portion of a groove of the golf club of FIG. 1, as defined by dashed region 122 in FIG. 1;

FIG. 3 depicts a portion of an edge of the groove of FIG. 2, as defined by dashed region 233 in FIG. 2;

FIG. 4 depicts a measurement of the edge of the groove of FIGS. 2 and 3;

FIG. 5 depicts a first simplified representation of a portion of the edge of FIG. 3, according to the first embodiment;

FIG. 21 depicts a simplified representation of a portion of the edge of FIG. 16, according to a fourteenth embodiment;

FIG. 22 depicts a simplified representation of a portion of the edge of FIG. 16, according to a fifteenth embodiment;

FIG. 23 depicts a simplified representation of a portion of the edge of FIG. 16, according to a sixteenth embodiment;

FIG. 24 depicts a simplified representation of a portion of the edge of FIG. 16, according to a seventeenth embodiment; and FIG. 25 depicts a method of manufacturing a golf club, according to an eighteenth embodiment.

Figure 6:
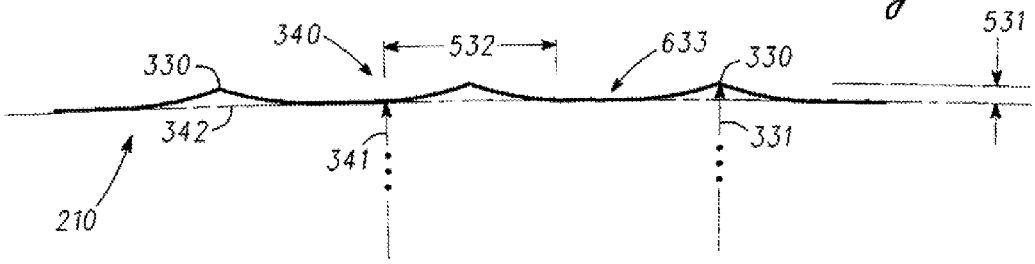
FIG. 6 depicts a second simplified representation of a portion of the edge of FIG. 3, according to a second embodiment.

For simplicity and clarity of illustration, the drawing figures illustrate the general manner of construction, and descriptions and details of well-known features and techniques may be omitted to avoid unnecessarily obscuring the golf clubs and their methods of manufacture. Additionally, elements in the drawing figures are not necessarily drawn to scale. For example, the dimensions of some of the elements in the figures may be exaggerated relative to other elements to help improve understanding of embodiments of the golf clubs and their methods of manufacture. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of golf clubs and methods of manufacture described herein are, for example, capable of operation in sequences other than those illustrated or otherwise described herein. Furthermore, the terms "contain," "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "side," "under," "over," and the like in the description and in the claims, if any, are used for descriptive purposes and not necessarily for describing permanent relative positions. It is to be understood that the terms so used are interchangeable under appropriate circumstances such that the embodiments of golf clubs and methods of manufacture described herein are, for example, capable of operation in other orientations than those illustrated or otherwise described herein. The term "coupled," as used herein, is defined as directly or indirectly connected in physically, mechanical, or other manner.

DESCRIPTION OF EXEMPLARY EMBODIMENTS

In one embodiment of golf club heads and methods of manufacture, a golf club head includes a strike face comprising one or more grooves having edges, where one or more of the edges is unsmooth. In another embodiment of golf clubs and methods of manufacture, a golf club comprises a golf club head body comprising a front face having substantially parallel channels. In this embodiment, the channels have borders, and at least one of the borders is uneven. Also in this embodiment, the golf club further comprises a shaft coupled to the golf club head body. In yet another embodiment of golf clubs and methods of manufacture, a method of manufacturing a golf club head comprises forming a strike face having one or more grooves with edges, where an edge of at least one of the one or more grooves is unsmooth. Other embodiments of golf clubs and methods of manufacture are also disclosed herein.

Turning now to the figures, FIG. 1 depicts a front view of golf club 100, according to a first embodiment. Golf club 100 can be an iron-type golf club head, such as a 1-iron, a 2-iron, a 3-iron, a 4-iron, a 5-iron, a 6-iron, a 7-iron, an 8-iron, a 9-iron, a sand wedge, a lob wedge, a pitching wedge, an n-degree wedge (e.g., 44 degrees (°), 48°, 52°, 56°, 60°, etc.), etc.

Golf club 100 includes golf club head body 110 and shaft 120 coupled to golf club head body 110. In the illustrated embodiment of FIG. 1, golf club head body 110 includes hosel 114 to which shaft 120 is coupled. In a different embodiment, golf club head body 110 has a hole, instead of hosel 114, to which shaft 120 is coupled.

Golf club head body 110 includes toe portion 115 and heel portion 116, where hosel 114 is located at heel portion 116. Golf club head body 110 also includes a perimeter 121 comprising sole 117 at a bottom portion of golf club head body 110 and also comprising top rail 118 at a top portion of golf club head body 110. Golf club head body 110 can also include notch 119 at heel portion 116.

Golf club head body 110 further includes back face 124 and front face 111 opposite back face 124. Front face 111 can also be referred to as a strike face. The strike face can be an integral part of golf club head body 110, or the strike face can be a separate piece from, or an insert for, golf club head body 110. The strike face includes one or more grooves 112, including groove 113. Groove 113 can be referred to as a channel, and grooves 112 can be referred to as channels. Grooves 112 can extend across the strike face from toe portion 115 of golf club head body 110 to heel portion 116 of golf club head body 110. Grooves 112 can also be stacked vertically above one another from sole 117 to top rail 118.

Grooves 112 can be compliant or non-compliant with, for example, the regulations regarding grooves that were proposed by the United States Golf Association (USGA) on Feb. 27, 2007. As an example, when compliant with these proposed regulations, grooves 112, including groove 113: (1) are straight and parallel with each other; (2) have a symmetrical cross-section and have sidewalls that do not converge toward the groove opening; (3) have a width, spacing, and cross-section that is consistent throughout the impact area of front face 111; (4) have a width that does not exceed 0.9 millimeters (mm) using the USGA's thirty degree method of measurement; (5) have a distance between adjacent grooves that is not less than three times the width of the grooves and that is not less than 1.905 mm; (6) have a depth that does not exceed 0.508 mm; and (7) have a cross-sectional area divided by a groove pitch (i.e., groove width plus spacing between adjacent grooves) that does not exceed 0.064 $mm^2$/mm. Additional details regarding grooves 112 are explained in the subsequent figures.

FIG. 2 depicts a cross-sectional view of a portion of groove 113 of golf club head body 110 (FIG. 1). The cross-section view of FIG. 2 is defined by dashed region 122 in FIG. 1. As depicted in FIG. 2, groove 113 has edges 210 and 211, sidewalls 220 and 221, and bottom 230. Edge 210 is adjacent to and couples front face 111 and sidewall 220, and edge 211 is adjacent to and couples front face 111 and sidewall 221. Bottom 230 is adjacent to and couples sidewalls 220 and 211. Edges 210 and 211 can also be referred to as borders. Groove 113 has depth 231, as defined by a substantially perpendicular distance between front face 111 and bottom 230.

Groove 113 can have a variety of overall cross-sectional shapes including, but not limited to, a U-shape, a V-shape, a rectangular-shape, a square-shape, and the like. In the embodiment illustrated in FIG. 2, groove 113 is symmetric such that edges 210 and 211 are substantially mirror images of each other, sidewalls 220 and 221 are substantially mirror images of each other, and the left and right halves of bottom 230 are substantially mirror images of each other. In a different embodiment, groove 113 can be asymmetric such that edges 210 and 211 are different from each other, sidewalls 220 and 221 are different from each other, and/or the left and right halves of bottom 230 are different from each other.

Turning to FIG. 3, a portion of edge 210 is depicted. The portion of FIG. 3 is defined by dashed region 233 in FIG. 2. As depicted in FIG. 3, edge 210 has an overall convex curve shape. Within that overall shape, however, edge 210 is unsmooth or uneven because edge 210 comprises one or more protrusions 330, which do not include the overall shape of edge 210. Also, FIG. 3 illustrates edge 210 to include five of protrusions 330, but edge 210 can include more or less than five of protrusions 330. Furthermore, protrusions 330 have peaks or peak points that remain below front face 111 and do not extend out of groove 113 (FIG. 2), but in a different embodiment, the peaks do not remain below front face 111 and/or do extend out of groove 113 (FIG. 2). In one embodiment, the peaks of protrusions 330 do not create an overall sharpness for edge 210, as best seen in FIG. 2. Additional details regarding protrusions 330 are described below.

Referring briefly back to the embodiment depicted in FIG. 2, the protrusions at edge 210 do not form a raised lip or a sharp edge for edge 210 or groove 113. Also, edge 211 is symmetric with edge 210 such that edge 211 is also unsmooth in the same manner as edge 210. In a different embodiment, edge 211 is unsmooth in a different manner than edge 210 (i.e., a different number, shape, or size of protrusions).

In another embodiment, still referring to FIG. 2, edge 211 is smooth while edge 210 is unsmooth. In this embodiment, the bottom edges of grooves 112 (FIG. 1) (i.e., the edges of a groove that are closer to sole 117 of golf club head body 110) can be smooth while the top edges of grooves 112 (FIG. 1) (i.e., the edges of a groove that are closer to top rail 118 of golf club head body 110) can be unsmooth.

In a further embodiment, edge 211 is unsmooth while edge 210 is smooth. In this embodiment, the bottom edges of grooves 112 (FIG. 1) can be unsmooth while the top edges of grooves 112 (FIG. 1) can be smooth.

The unsmooth or uneven characteristic of edge 210 (and/or edge 211 (FIG. 2)) can be defined by, as one example, two or more inflection points. The unsmooth or uneven characteristic of edge 210 can produce a sharp corner for edge 210, or the unsmooth or uneven characteristic of edge 210 can produce a non-sharp or even a dull corner for edge 210.

The unsmooth or uneven characteristic of edge 210 and/or edge 211 can, under certain conditions, increase the grip that front face 111 (FIG. 1) has on a golf ball when front face 111 of golf club head body 110 (FIG. 1) impacts the golf ball. As a result of the increased or improved grip, the golf ball can, under certain conditions, have a higher rate of backspin, which can, under certain conditions, improve the consistency of a golf shot from golf club 100 (FIG. 1) in a variety of playing conditions.

As also depicted in FIGS. 2 and 3, protrusions 330 are located at edge 210 and/or edge 211, but are absent from sidewalls 220 and 221. In a different embodiment, protrusions 330 can also be located at one or both of sidewalls 220 and 221. This different embodiment can be useful if front face 111 and/or edges 210 and 211 are soft or otherwise deformable so that protrusions 330 at sidewalls 220 and 221 can grip the golf ball when front face 111 impacts the golf ball.

Protrusions 330 can also be referred to as projections and can include protuberances, extensions, and undulations. As best seen in FIGS. 2 and 3, protrusions 330 can be substantially parallel to groove 113. Accordingly, in an embodiment where each edge of grooves 112 (FIG. 1) have protrusions 330, each of protrusions 330 can be parallel to each of grooves 112.

Protrusions 330 can be regularly or irregularly shaped. Protrusions 330 can also be symmetric (vertically, horizontally, or otherwise) such that a first half of a protrusion is substantially a mirror image of a second half of the same protrusion, or protrusion 330 can be asymmetric such that a first half of a protrusion is different from a second half of the same protrusion. Protrusions 330 can further be symmetric such that a first one of protrusions 330 is substantially a mirror image of a second one of protrusions 330, or protrusions 330 can be asymmetric such that a first one of protrusions 330 is different from a second one of protrusions 330.

Protrusions 330 have peaks and concave sides. The concave sides between adjacent protrusions 330 define valleys 340. Accordingly, protrusions 330 can have a scallop-like configuration, as depicted in FIG. 3, but other configurations are also contemplated, as shown in the subsequent figures.

The peaks of protrusions 330 in FIG. 3 define curve 332. Curve 332 is represented by a dashed line in FIG. 3, and curve 332 has a radius 331. Similarly, the bottom portions of valleys 340 define curve 342. Curve 342 is represented by another dashed line in FIG. 3, and curve 342 has radius 341. As depicted in FIG. 3, curves 332 and 342 are concentric or parallel with each other; radii 331 and 341 originate from the same point 335; and radius 341 is smaller than radius 331. In one embodiment, each of radius 331 and radius 341 is greater than or equal to approximately 0.254 mm. In another embodiment, each of radius 331 and radius 341 is greater than or equal to approximately 1.016 mm. Either one or both of radius 331 and radius 341 can be referred to as an effective radius of edge 210, and in the same or different embodiment, each edge of grooves 112 (FIG. 1) can have radius 331 and radius 341, or only one edge of each of grooves 112 (FIG. 1) can have radius 331 and radius 341 while the other edge of each of grooves 112 (FIG. 1) has radius 341.

Referring back to FIG. 1, one or more other ones of grooves 112 can be similar, identical, or symmetric to groove 113. In one embodiment, groove 113 is asymmetric, but each of grooves 112 is symmetric with groove 113. As another example, in another embodiment, groove 113 is symmetric, and every second one or every third one of grooves 112 is symmetric with groove 113. In this embodiment, the ones of grooves 112 that are not symmetric to groove 113 can have a different cross-sectional shape, one smooth edge and one unsmooth edge, one or two edges with a different number of protrusions, a different shape of protrusions, and/or a different height or with of protrusions. Other variations are also contemplated herein.

Turning to FIG. 4, a proposed USGA measurement of the sharpness of edge 210 of groove 113 of FIGS. 2 and 3 is depicted. In particular, FIG. 4 shows two dashed concentric circles 442 and 444 having radii 441 and 443, respectively. The smaller circle, circle 442, is tangential to front face 111 and to sidewall 220, and sidewall 220 has an angle 443.

Edge 210 is not sharp and is in compliance with the aforementioned proposed USGA regulations regarding grooves when:

$$\text{radius}_{341} \geq \text{radius}_{441} + \frac{\text{radius}_{443} - \text{radius}_{441}}{\left(1 - \frac{\sqrt{2}}{\sin(\text{angle}_{443})}\sqrt{1 - \cos(\text{angle}_{443})}\right)} \quad \text{(Eq. 1)}$$

and $$\text{radius}_{331} \geq \text{radius}_{441} + \frac{\text{radius}_{443} - \text{radius}_{441}}{\left(1 - \frac{\sqrt{2}}{\sin(\text{angle}_{443})}\sqrt{1 - \cos(\text{angle}_{443})}\right)}. \quad \text{(Eq. 2)}$$

In one embodiment, edge 210 can be defined by the portion of groove 113 that is located within circles 442 and 444. In the same or different embodiment, edge 210 is defined as being located between front face 111 and sidewall 220. In one example of this embodiment, front face 111 and sidewall 220 can be flat such that edge 210 is the non-flat portion located between the flat surfaces of front face 111 and sidewall 220. Other configurations for edge 210 are also contemplated herein.

Referring back to FIG. 3, protrusions 330 protrude or extend from edge 210. Arrow 350 shows a direction that a drill bit or micromachining tool can move along edge 210 to form valleys 340 and protrusions 330 after casting, forging, machining, or otherwise forming front face 111 and/or golf club head body 110 (FIG. 1). In one embodiment, each of valleys 340 represents a single cut or pass of a micromachining tool along edge 210. In a different embodiment, a single cut or pass of a micromachining tool along edge 210 can simultaneously form two or more of valleys 340.

FIG. 5 depicts a first simplified representation of a portion of edge 210 of FIG. 3, according to the first embodiment. FIG. 5 is a simplified representation because, in part, the overall shape of edge 210 is not shown to be curved, as depicted in FIG. 3. Also, FIG. 5 shows only a portion of edge 210.

Each of protrusions 330 has a width 532, which is less than a width of groove 113 (FIG. 2). Each of protrusions 330 also have a height 531 above edge 210. Height 531 is the difference between radius 331 and 341, and therefore, height 531 is measured radially from edge 210. Height 531 of protrusions 330 is less than depth 231 (FIG. 2) of groove 113 (FIG. 2). In one embodiment, distance 531 is up to approximately 0.0254 mm. In the same embodiment, width 532 is approximately 0.254 mm or greater, and the ratio of distance 531 to width 532 can be approximately 1:10 or greater. In the same or a different embodiment, distance 531 is up to approximately ten percent of radius 331 and/or radius 341. In another embodiment, width 532 can be less than 0.254 mm, and/or distance 531 can be greater than 0.0254 mm.

As also depicted in FIG. 5, portions 533 of edge 210 located between two adjacent ones of protrusions 330 are substantially smooth, substantially uniform, and substantially curved. The curves are depicted to be concave, but in another embodiment, the curve can be convex.

FIG. 6 depicts a second simplified representation of a portion of edge 210 of FIG. 3, according to a second embodiment. FIG. 6 is similar to FIG. 5, except that adjacent ones of protrusions 330 in FIG. 6 are spaced apart from each other by portions 633 of edge 210. As an example, portions 633 can space apart adjacent ones of protrusions 330 by a distance of up to approximately 0.3 mm. In one embodiment, adjacent ones of protrusions 330 can be separated from each other by the same distance, or by different distances. In contrast, the distance between adjacent ones of protrusions 330 in FIG. 5 is substantially zero. Portions 633 in FIG. 6 can be substantially planar, or can be convexly or concavely curved or can have a different configuration.

Figure 7:
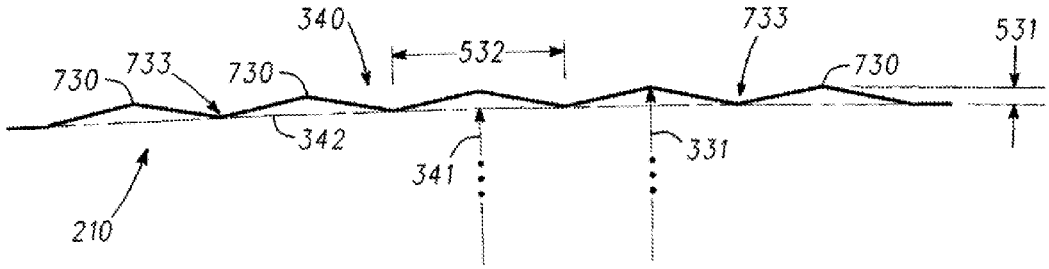
FIG. 7 depicts a third simplified representation of a portion of the edge of FIG. 3, according to a third embodiment.

FIG. 7 depicts a third simplified representation of a portion of edge 210 of FIG. 3, according to a third embodiment. FIG. 7 is similar to FIG. 5, except that FIG. 7 depicts protrusions 730, which have substantially straight sides instead of the concave sides of protrusions 330 in FIG. 5. Also, in FIG. 7, portions 733 of edge 210 are located between adjacent ones of protrusions 730 and have an overall V-shape.

Figure 8:
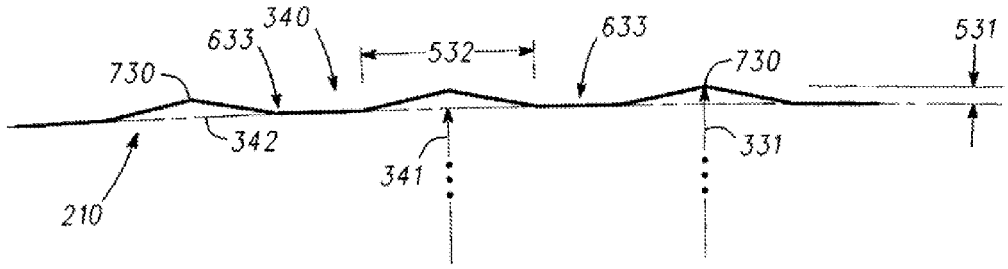
FIG. 8 depicts a fourth simplified representation of a portion of the edge of FIG. 3, according to a fourth embodiment.

FIG. 8 depicts a fourth simplified representation of a portion of edge 210 of FIG. 3, according to a fourth embodiment. FIG. 8 is similar to FIG. 7, except that adjacent ones of protrusions 730 in FIG. 8 are spaced apart from each other by portions 633 of edge 210.

Figure 9:
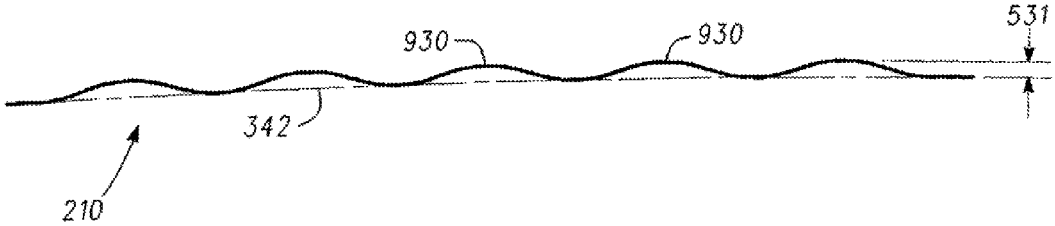
FIG. 9 depicts a fifth simplified representation of a portion of the edge of FIG. 3, according to a fifth embodiment.

FIG. 9 depicts a fifth simplified representation of a portion of edge 210 of FIG. 3, according to a fifth embodiment. FIG. 9 is similar to FIG. 5, except that FIG. 9 depicts protrusions 930, which have curved top surfaces or rounded peaks instead of the pointed peaks of protrusions 330 in FIG. 5. In a different embodiment, adjacent ones of protrusions 930 can be separated by portions 633 (FIG. 6) of edge 210.

Figure 10:
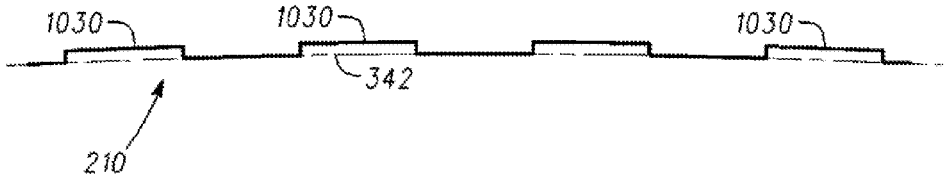
FIG. 10 depicts a sixth simplified representation of a portion of the edge of FIG. 3, according to a sixth embodiment.

FIG. 10 depicts a sixth simplified representation of a portion of edge 210 of FIG. 3, according to a sixth embodiment. FIG. 10 is similar to FIG. 6, except that FIG. 10 depicts protrusions 1030, which are substantially rectangularly shaped and have a substantially planar top surface. In a different embodiment, protrusions 1030 can have rounded top surfaces, which can be concentric or parallel with curve 342.

Figure 11:
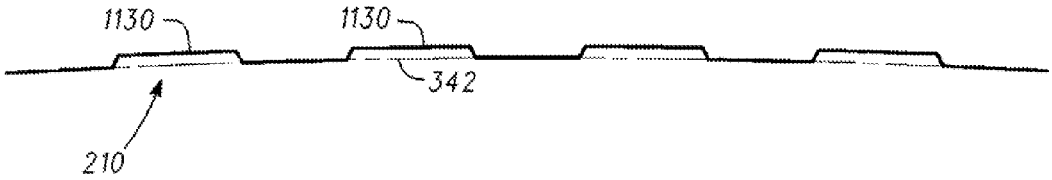
FIG. 11 depicts a seventh simplified representation of a portion of the edge of FIG. 3, according to a seventh embodiment.

FIG. 11 depicts a seventh simplified representation of a portion of edge 210 of FIG. 3, according to a seventh embodiment. FIG. 11 is also similar to FIG. 6, except that FIG. 11 depicts protrusions 1130, which are substantially trapezoidally shaped and have a substantially planar top surface. In a different embodiment, adjacent ones of protrusions 1130 can be contiguous with each other, and/or protrusions 1130 can have rounded top surfaces, which can be concentric or parallel with curve 342.

Figure 12:
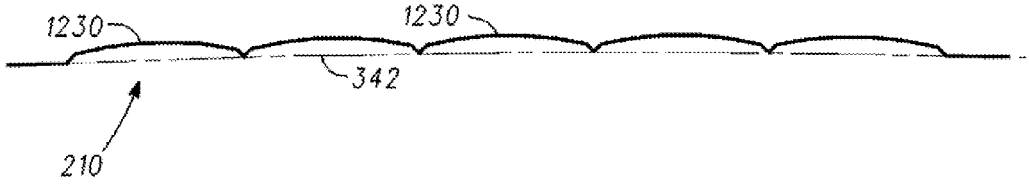
FIG. 12 depicts an eighth simplified representation of a portion of the edge of FIG. 3, according to an eighth embodiment.

FIG. 12 depicts an eighth simplified representation of a portion of edge 210 of FIG. 3, according to an eighth embodiment. FIG. 12 is similar to FIG. 7, except that FIG. 12 depicts protrusions 1230, which have curved top surfaces or rounded peaks. Protrusions 1230 can be vertical combinations of protrusions 730 (FIG. 7) and protrusions 930 (FIG. 9). Other combinations and permutations for the protrusions are also contemplated herein. For example, instead of stacking protrusions 930 above protrusions 730, the protrusions across edge 210 can alternate between protrusions 930 and protrusions 730.

Figure 13:
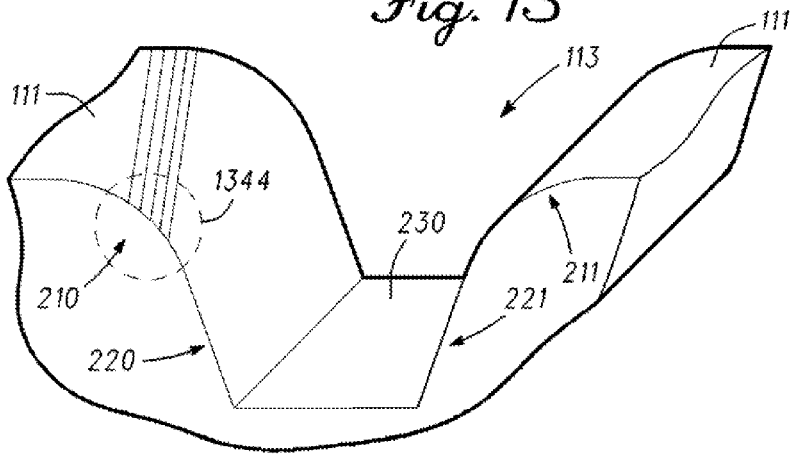
FIG. 13 depicts a second cross-sectional view of the portion of the groove of the golf club of FIG. 1, according to a ninth embodiment, where the cross-sectional view of FIG. 13 is defined by dashed region 122 in FIG. 1.
Figure 14:
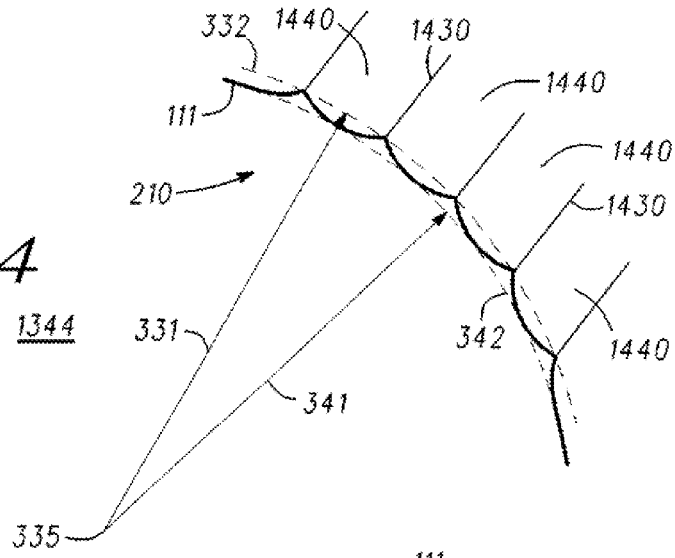
FIG. 14 depicts a portion of an edge of the groove of FIG. 13, according to the ninth embodiment, where the portion of the edge in FIG. 14 is defined by dashed region 1344 in FIG. 13.

FIG. 13 depicts a second cross-sectional view of a portion of groove 113 of golf club 100 of FIG. 1, according to a ninth embodiment, where the cross-sectional view of FIG. 13 is defined by dashed region 122 in FIG. 1. FIG. 14 depicts a portion of edge 210 of FIG. 13, according to the ninth embodiment, where the portion of edge 210 in FIG. 14 is defined by dashed region 1344 in FIG. 13.

FIGS. 13 and 14 are similar to FIGS. 2 and 3, respectively, except that FIGS. 13 and 14 depict protrusions 1430 and valleys 1440 to not be substantially parallel to groove 113 while FIGS. 2 and 3 depict protrusions 330 and valleys 340 to be substantially parallel to groove 113. Except for their non-parallel orientation, protrusions 1430 and valleys 1440 in FIGS. 13 and 14 can be similar to protrusions 330 and valleys 340 in FIGS. 2 and 3. Also, FIG. 14 illustrates edge 210 to include five of protrusions 1430, but edge 210 can include more or less than five of protrusions 1430.

Although protrusions 1430 are not parallel to groove 113, protrusions 1430 can be perpendicular to the direction of the golf ball when front face 111 (FIG. 1) of golf club head body 110 (FIG. 1) is "open" or otherwise "misaligned" during impact of front face 111 with the golf ball. Protrusions 1430 can have the different variations described with reference to FIGS. 5-12. In a different embodiment, the protrusions can be slanted in an opposite direction than depicted in FIG. 13 such that the protrusions are substantially perpendicular to the direction of the golf ball when front face 111 (FIG. 1) of the golf club head body 110 (FIG. 1) is "closed" during impact of front face 111 with the golf ball. Other variations for the protrusions are also contemplated herein.

Figure 15:
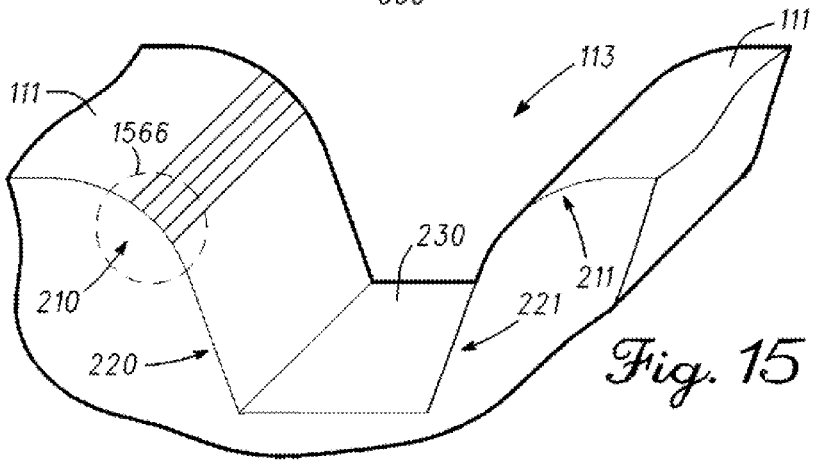
FIG. 15 depicts a third cross-sectional view of the portion of the groove of the golf club of FIG. 1, according to a tenth embodiment, where the cross-sectional view of FIG. 15 is defined by dashed region 122 in FIG. 1.
Figure 16:
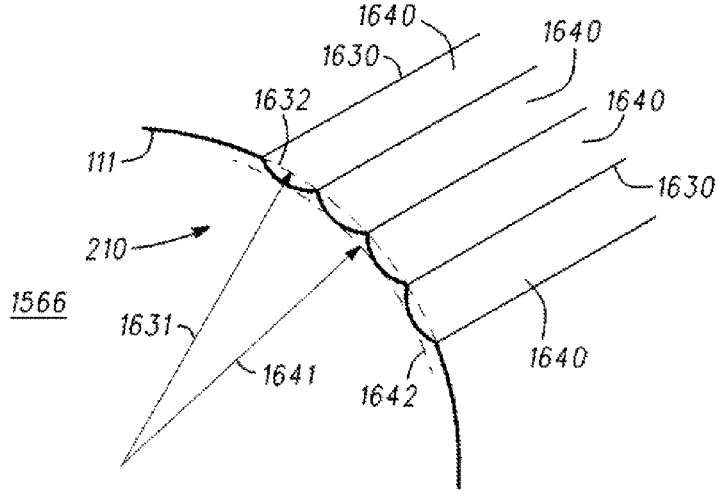
FIG. 16 depicts a portion of an edge of the groove of FIG. 15, according to the tenth embodiment, where the portion of the edge in FIG. 16 is defined by dashed region 1566 in FIG. 15.

FIG. 15 depicts a third cross-sectional view of a portion of groove 113 of golf club 100 of FIG. 1, according to a tenth embodiment, where the cross-sectional view of FIG. 15 is defined by dashed region 122 in FIG. 1. FIG. 16 depicts a portion of edge 210 of FIG. 15, according to the tenth embodiment, where the portion of edge 210 in FIG. 16 is defined by dashed region 1566 in FIG. 15.

FIGS. 15 and 16 are similar to FIGS. 2 and 3, respectively, except that the peaks of protrusions 1630 in FIG. 16 do not extend out or otherwise enlarge a radius of edge 210, as shown in FIGS. 3, 5-12, and 14. Instead, the bottoms of valleys 1640 extend into or reduce a radius of edge 210. Therefore, protrusions 1630 and valleys 1640 in FIG. 16 are formed using a different process than used to form protrusions 330 and valleys 340 in FIG. 3. In particular, valleys 1640 in FIG. 16 are formed as depressions, and the formation of valleys 1640 forms protrusions 1630. Accordingly, curve 1632, which is drawn as a dashed line in FIG. 16, represents the original surface of edge 210 before forming valleys 1640 and protrusions 1630. Therefore, in this way, curve 1632 in FIG. 16 can be analogous to curve 332 in FIGS. 3 and 4. Although FIG. 16 illustrates edge 210 to include five of protrusions 1630, but edge 210 can include more or less than five of protrusions 1630.

After forming valleys 1640 and protrusions 1630, the peaks of protrusions 1630 define dashed curve 1632. The bottoms of valleys 1640 define dashed curve 1642, and curves 1632 and 1642 have radii 1631 and 1641, respectively. Although protrusions 1630 and valleys 1640 in FIGS. 15 and 16 are formed using a different process than the protrusions and valleys described with reference to FIGS. 2, 3, and 5-14, edge 210 in FIGS. 15 and 16 can still comply with the proposed USGA's groove regulations referenced above with respect to FIG. 4 when:

$$\text{radius}_{1641} \geq \text{radius}_{441} + \frac{\text{radius}_{443} - \text{radius}_{441}}{\left(1 - \frac{\sqrt{2}}{\sin(\text{angle}_{443})}\sqrt{1 - \cos(\text{angle}_{443})}\right)} \quad \text{(Eq. 3)}$$

and $$\text{radius}_{1631} \geq \text{radius}_{441} + \frac{\text{radius}_{443} - \text{radius}_{441}}{\left(1 - \frac{\sqrt{2}}{\sin(\text{angle}_{443})}\sqrt{1 - \cos(\text{angle}_{443})}\right)}. \quad \text{(Eq. 4)}$$

Figure 17:
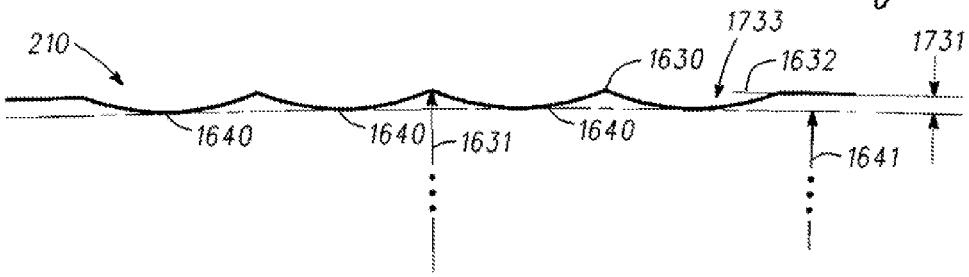
FIG. 17 depicts a simplified representation of a portion of the edge of FIG. 16, according to the tenth embodiment.

FIG. 17 depicts a simplified representation of a portion of edge 210 in FIG. 16, according to the tenth embodiment. FIG.

17 is a simplified representation because, in part, the overall shape of edge 210 is not shown to be curved, as depicted in FIG. 16. Also, FIG. 17 shows only a portion of edge 210.

As depicted in FIG. 17, protrusions 1630 have height 1731, which also represents the depth of valleys 1640 from the original surface of edge 210. Portions 1733 located between two adjacent ones of protrusions 1630 are substantially smooth, substantially uniform, and substantially curved. The curves are depicted to be concave, but in another embodiment, the curve can be convex.

Figure 18:
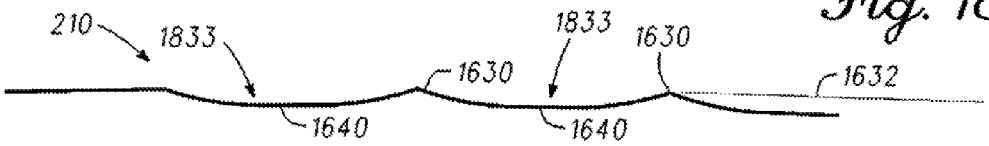
FIG. 18 depicts a simplified representation of a portion of the edge of FIG. 16, according to an eleventh embodiment.

FIG. 18 depicts another simplified representation of a portion of edge 210 in FIG. 16, according to an eleventh embodiment. FIG. 18 is similar to FIG. 17, except that adjacent ones of protrusions 1630 in FIG. 18 are spaced apart from each other by portions 1833. As an example, portions 1833 can space apart adjacent ones of protrusions 1630 by a distance of up to approximately 0.3 mm. In one embodiment, adjacent ones of protrusions 1630 can be separated from each other by the same distance, or by different distances. In contrast, the distance between adjacent ones of protrusions 1630 in FIG. 17 is substantially zero. Portions 1833 in FIG. 18 can be substantially planar, or can be convexly or concavely curved or can have a different configuration.

Figure 19:
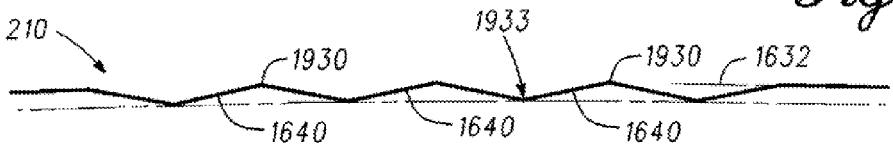
FIG. 19 depicts a simplified representation of a portion of the edge of FIG. 16, according to a twelfth embodiment.

FIG. 19 depicts another simplified representation of a portion of edge 210 of FIG. 16, according to a twelfth embodiment. FIG. 19 is similar to FIG. 17, except that FIG. 19 depicts protrusions 1930, which have substantially straight sides instead of the concave sides of protrusions 1630 in FIG. 17. Also, in FIG. 19, portions 1933 are located between adjacent ones of protrusions 730 and have an overall V-shape.

Figure 20:
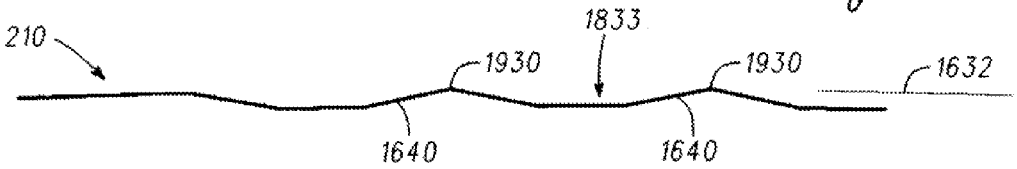
FIG. 20 depicts a simplified representation of a portion of the edge of FIG. 16, according to a thirteenth embodiment.

FIG. 20 depicts another simplified representation of a portion of edge 210 of FIG. 16, according to a thirteenth embodiment. FIG. 20 is similar to FIG. 19, except that adjacent ones of protrusions 1930 in FIG. 20 are spaced apart from each other by portions 1833.

FIG. 21 depicts another simplified representation of a portion of edge 210 of FIG. 16, according to a fourteenth embodiment. FIG. 21 is similar to FIG. 17, except that FIG. 21 depicts protrusions 2130, which have curved top surfaces or rounded peaks instead of the pointed peaks of protrusions 1630 in FIG. 17. In a different embodiment, adjacent ones of protrusions 2130 can be separated by portions 1833 (FIG. 18) of edge 210.

FIG. 22 depicts another simplified representation of a portion of edge 210 of FIG. 16, according to a fifteenth embodiment. FIG. 22 is similar to FIG. 18, except that FIG. 22 depicts protrusions 2230, which are substantially rectangularly shaped and have a substantially planar top surface. In a different embodiment, protrusions 2230 can have rounded top surfaces, which can be concentric or parallel with curve 1632.

FIG. 23 depicts another simplified representation of a portion of edge 210 of FIG. 16, according to a sixteenth embodiment. FIG. 23 is also similar to FIG. 18, except that FIG. 23 depicts protrusions 2330, which are substantially trapezoidally shaped and have a substantially planar top surface. In a different embodiment, adjacent ones of protrusions 2330 can be contiguous with each other, and/or protrusions 2330 can have rounded top surfaces, which can be concentric or parallel with curve 1632.

FIG. 24 depicts another simplified representation of a portion of edge 210 of FIG. 16, according to an seventeenth embodiment. FIG. 24 is similar to FIG. 19, except that FIG. 24 depicts protrusions 2430, which have curved top surfaces or rounded peaks. Protrusions 2430 in FIG. 24 can be similar to protrusions 1230 in FIG. 12. Other variations to protrusions 1630 (FIGS. 16 and 17) are also contemplated herein.

FIG. 25 depicts method 2500 of manufacturing a golf club, according to a eighteenth embodiment. Method 2500 includes forming a strike face comprising one or more grooves having edges, where an edge of at least one of the one or more grooves is unsmooth (a block 2510). In one embodiment, block 2510 could include casting the strike face with the grooves and the unsmooth edge or edges. In a different embodiment, block 2510 could include casting the strike face with the grooves and, afterwards, machining, micromachining, and/or growing the edges to make them unsmooth. For example, micromachining the edges can include micromachining projections into the edges. In another embodiment, block 2510 could include casting the strike face without the grooves and, afterwards, machining or micromachining the grooves into the strike face and then machining, micromachining, or growing the edges to make them unsmooth. In an additional embodiment, the casting process identified above can be replaced with a forging process and/or a machining process. In another embodiment, the growing process identified above can include an epitaxial growing process. Block 2510 can be used to form the projections in the edges of the grooves, regardless of whether the projections are similar to the projections of: (a) FIGS. 2, 3, and 5-12; (b) FIGS. 13-14; or (c) FIGS. 15-24.

Method 2500 can continue with forming a golf club head body (a block 2520). The forming process of block 2520 could also include casting, forging, and/or micromachining. In some embodiments, blocks 2510 and 2520 can be performed in a reverse sequence or simultaneously with each other. In an embodiment where blocks 2510 and 2520 are performed separately, method 2500 includes coupling the strike face to the golf club head body (a block 2530). In an embodiment where blocks 2510 and 2520 are performed simultaneously, the strike face is integral with the golf club head body, and block 2530 can be omitted from method 2500. In this embodiment, however, the edges of the grooves could still be made unsmooth after or while casting the entire golf club head body.

Method 2500 continues with coupling a shaft to the golf club head body (a block 2540). As explained above, the shaft can be coupled to a hole in the golf club head body or to a hosel of the golf club head body.

The disclosure of embodiments of golf clubs and methods of manufacture is intended to be illustrative of the scope of golf clubs and methods of manufacture and is not intended to be limiting. For example, the details of the grooves described with reference to FIGS. 1-25 can be applied to not only irons, but also drivers and other woods, hybrid clubs, putters, and other types of golf clubs. Furthermore, the protrusions at a single edge of a groove can be evenly or unevenly spaced apart from each other, or the density, size, and/or shape of the protrusions can be different at different parts of the same groove. Moreover, the protrusions do not need to extend along the length of the groove. Instead, the protrusions can be more similar to bumps or other smaller sized protrusions, or the protrusions can be curved, bent, crooked, etc. As another example, front face 111 can also be unsmooth and have protrusions. Still further, the unsmooth edges of grooves can be implemented for only certain clubs within a set of golf clubs to adjust or otherwise customize the golf clubs for a particular golfer. For example, in one embodiment, only the groove edges of the sand wedge and the pitching wedge are unsmooth. In another embodiment, if a golfer has problems creating backspin on the golf ball under certain conditions with his lower numbered irons (i.e., a 2-iron, a 3-iron, and a 4-iron), then only the groove edges of those lower number irons can be unsmooth.

Furthermore, the golf clubs and methods of manufacture discussed herein may be implemented in a variety of embodiments, and the foregoing discussion of these embodiments does not necessarily represent a complete description of all possible embodiments. Rather, the detailed description of the drawings, and the drawings themselves, disclose at least one preferred embodiment of golf clubs and methods of manufacture, and may disclose alternative embodiments of golf clubs and methods of manufacture. It is intended that the scope of golf clubs and methods of manufacture shall be defined by the appended claims.

All elements claimed in any particular claim are essential to golf clubs or methods of manufacture claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head comprising:
a strike face comprising:
a body comprising a body surface; and
one or more grooves at the body surface;
wherein:
a first groove of the one or more grooves comprises a first edge;
the first edge comprises a first unsmooth surface at the body of the strike face, and
the first unsmooth surface, the first edge, the first groove, and the body surface of the body of the strike face comprise a single piece.

2. The golf club head of claim 1, wherein:
the first edge comprises one or more projections.

3. The golf club head of claim 2, wherein:
the first groove comprises a second edge opposite the first edge; and
the second edge comprises a smooth surface devoid of projections.

4. The golf club head of claim 2, wherein:
the first groove comprises a second edge opposite the first edge; and
the second edge comprises a same number of projections as the first edge.

5. The golf club head of claim 2, wherein:
the one or more projections of the first edge comprise a first projection;
the first groove comprises a second edge opposite the first edge; and
the second edge comprises at least one of:
a different number of projections than the first edge;
a second projection having a different size than the first projection; or
a second projection having a different shape than the first projection.

6. The golf club head of claim 2, wherein:
the one or more projections extend along the first edge substantially parallel to the first groove.

7. The golf club head of claim 2, wherein:
the one or more projections extend along substantially a whole length of the first edge.

8. The golf club head of claim 2, wherein:
the one or more projections extend substantially non-parallel to the first groove.

9. The golf club head of claim 2, wherein:
a region between two adjacent projections of the one or more projections is substantially smooth.

10. The golf club head of claim 2, wherein:
a region between two adjacent projections of the one or more projections is at least one of:
substantially curved;
substantially planar; or
substantially V-shaped.

11. The golf club head of claim 2, wherein:
the one or more projections comprise substantially planar top surfaces.

12. The golf club head of claim 2, wherein:
the one or more projections comprise curved top surfaces.

13. The golf club head of claim 2, wherein:
the one or more projections comprise peaked top points.

14. The golf club head of claim 2, wherein:
each of the one or more grooves comprises an edge;
each edge of the one or more grooves comprises at least one projection;
the first edge of the first groove comprises the edge; and
the one or more projections of the first edge comprise the at least one projection.

15. The golf club head of claim 2, wherein:
a second groove of the one or more grooves comprises a second edge;
the second edge comprises one of:
a different number of projections than the first edge;
a smooth surface devoid of projections; or
a same number of projections as the first edge.

16. The golf club head of claim 2, wherein:
the one or more projections remain below the body surface of the strike face.

17. The golf club head of claim 2, wherein:
the first groove comprises a first sidewall adjacent to the first edge; and
the one or more projections are at least one of:
absent from the first sidewall; or
separated from each other by a distance less than approximately 0.3 millimeters.

18. The golf club head of claim 1, wherein:
each of the one or more grooves comprises two unsmooth edges.

19. The golf club head of claim 1, wherein:
each of the one or more grooves comprises:
a smooth edge; and
an unsmooth edge.

20. The golf club head of claim 19, wherein:
for at least one of the one or more grooves:
the smooth edge is closer to a sole of the golf club head than the unsmooth edge.

21. The golf club head of claim 1, wherein:
the first unsmooth surface, the first edge, the first groove, and the body surface of the body of the strike face comprise a single material.

22. A golf club head comprising:
a strike face comprising:
a body; and
one or more grooves at a surface of the body;

wherein:

a first groove of the one or more grooves comprises a first edge;

the first edge comprises a first unsmooth surface at the body of the strike face; and the first unsmooth surface, the first edge, the first groove, and the surface of the body comprise a single material.

23. The golf club head of claim 22, wherein:

the first groove comprises a first sidewall adjacent to the first edge; and the first edge comprises one or more projections that are at least one of:

absent from the first sidewall; or separated from each other by a distance of less than approximately 0.3 millimeters.

24. A method of manufacturing a golf club head comprising:

forming a strike face comprising one or more grooves having edges;

wherein forming the strike face comprises:

forming a first groove of the one or more grooves to comprise a first edge of the edges at a body surface of a body of the strike face; and forming the first edge to comprise a first unsmooth surface.

25. The method of claim 24, wherein:

forming the strike face comprises:

forming the first unsmooth surface, the first edge, the first groove, and the body surface of the body of the strike face from at least one of:

a single piece; or a single material.

26. The method of claim 24, wherein:

forming the strike face comprises at least one of:

(A) micromachining projections into at least the first edge of the first groove; or (B) forging the strike face such that the first edge of the first groove has an effective radius greater than or equal to approximately 1.016 millimeters; and afterwards, micromachining projections into at least the first edge while maintaining the effective radius; or (C) casting the strike face such that the first edge of the first groove has an effective radius greater than or equal to approximately 1.016 millimeters; and afterwards, micromachining projections into at least the first edge while maintaining the effective radius; or (D) machining the strike face such that the first edge of the first groove has an effective radius greater than or equal to approximately 1.016 millimeters; and afterwards, micromachining projections into at least the first edge while maintaining the effective radius; or (E) initially forming the strike face without the one or more grooves;

afterwards, machining the first groove into the strike face; and afterwards, micromachining projections into at least the first edge while maintaining the effective radius.

27. The method of claim 24, further comprising:

coupling the strike face to a golf club head body; or forming the strike face integral with the golf club head body.

28. The method of claim 24, wherein:

forming the strike face further comprises:

providing a set of grooves in the strike face, wherein the one or more grooves comprise the set of grooves and wherein each groove of the set of grooves comprises two edges; and at least one of:

providing protrusions at at least one of the two edges of each groove in the set of grooves; or providing protrusions at both of the two edges of each groove in the set of grooves.

* * * * *